United States Patent [19]

Sanford

[11] 4,180,817

[45] Dec. 25, 1979

[54] SERIALLY CONNECTED MICROSTRIP ANTENNA ARRAY

[75] Inventor: Gary G. Sanford, Boulder, Colo.

[73] Assignee: Ball Corporation, Muncie, Ind.

[21] Appl. No.: 683,203

[22] Filed: May 4, 1976

[51] Int. Cl.[2] ..... H01Q 1/38; H01Q 3/26

[52] U.S. Cl. ..... 343/700 MS; 343/854

[58] Field of Search ..... 343/700 MS, 846, 854

[56] References Cited

U.S. PATENT DOCUMENTS

| | | | |
|---|---|---|---|
| 3,221,332 | 11/1965 | Kravis et al. | 343/792.5 |
| 3,377,592 | 4/1968 | Robieux et al. | 343/854 |
| 3,643,262 | 2/1972 | Dumanchin | 343/700 MS |
| 3,775,771 | 11/1973 | Scherer | 343/770 |
| 3,803,623 | 4/1974 | Charlot | 343/700 MS |
| 3,806,946 | 4/1974 | Tiuri | 343/731 |
| 3,921,177 | 11/1975 | Munson | 343/700 MS |
| 3,987,455 | 10/1976 | Olyphant | 343/700 MS |
| 3,995,277 | 11/1976 | Olyphant | 343/700 MS |

FOREIGN PATENT DOCUMENTS

| | | | |
|---|---|---|---|
| 1050583 | 1/1954 | France | 343/700 MS |
| 798821 | 7/1958 | United Kingdom | 343/708 |

*Primary Examiner*—Eli Lieberman
*Attorney, Agent, or Firm*—J. David Haynes

[57] ABSTRACT

Radio frequency antenna arrays of radiating slot apertures serially connected along a predetermined path transverse to the radiating slot apertures. In the exemplary embodiments, the radiating slot apertures are formed by parallel edges of conductive radiator surfaces where the edges are spaced apart by substantially one-half wavelength at the anticipated antenna operating frequency. Such radiator surfaces are, in some embodiments, dimensioned in a direction parallel to the apertures in relation to the relative proportion of radio frequency energy which is to be radiated to/from the slot apertures associated therewith to thus determine the total array aperture amplitude taper while the spacing between the radiator surfaces determines the phase taper across the total array aperture. Other exemplary embodiments utilize internal reflections in an array to determine the array amplitude taper and still other exemplary embodiments combine a plurality of such arrays to form two-dimensional special purpose arrays.

35 Claims, 5 Drawing Figures

SERIALLY CONNECTED MICROSTRIP ANTENNA ARRAY

This invention generally relates to radio frequency antenna structures and, more particularly, to an array of radiating slot apertures defined by the so-called microstrip radiators wherein such apertures are serially connected along a predetermined path substantially transverse to the lengthwise dimension of such radiating slot apertures.

Microstrip radiator structures, per se, of various shapes and applications have been disclosed in commonly assigned U.S. Pat. Nos. 3,713,162 issued Jan. 23, 1973; 3,810,183 issued May 7, 1974; 3,811,128 issued May 14, 1974; and 3,921,177 issued Nov. 18, 1975 and also in commonly assigned copending U.S. Pat. applications Ser. Nos. 511,706 filed Oct. 3, 1974, now U.S. Pat. No. 3,938,161; 607,418 filed Aug. 25, 1975, now U.S. Pat. No. 3,971,032; 596,263 filed July 16, 1975, now U.S. Pat. No. RE29,296; 620,196 filed Oct. 6, 1975, now U.S. Pat. No. 4,070,676; 620,272 filed Oct. 7, 1975, now U.S. Pat. No. 4,012,741 and 658,534 filed Feb. 17, 1976, now U.S. Pat No. 4,051,477. It is believed that the invention described in the present application will find application with many, if not all, of the specific types of microstrip radiator structures disclosed in these earlier copending applications and/or patents.

As will be appreciated by those in the art, microstrip radiators, per se, are specially shaped and dimensioned conductive surfaces overlying a larger ground plane surface and spaced therefrom by a relatively small fraction of wavelength with a dielectric material. Typically, microstrip radiators are formed either singly or in arrays by photo-etching processes exactly similar to those utilized for forming printed circuit board structures of conductive surfaces. The starting material used in forming such microstrip radiators is also quite similar if not identical to conventional printed circuit board stock in that it comprises a dielectric sheet laminated between two conductive sheets. Typically, one side of such a structure becomes the ground or reference plane of a microstrip antenna while the other opposite surface spaced therefrom by the dielectric layer is photo-etched to form the actual microstrip radiator, per se, or some array of such radiators together with microstrip transmission feedlines thereto. One or more edges of such microstrip radiators defines a radiating slot aperture therealong between that edge and the underlying ground plane surface from which the actual antenna radiation emanates.

It is recognized that some antenna functions are best implemented using a series feed network as discussed, for example, by Simmons, et al "A Multiple-Beam Two-Dimensional Waveguide Slot Array" IEE Int. Conv. Rec., Part 1, 56–69. Typically, the so-called microstrip radiator antenna arrays have, in the past, been fed with microstrip transmission line having a corporate structure as will be apparent to those in the art form, inter alia, some of the above-referenced issued patents. This corporate structured microstrip feedline for an array of microstrip radiators utilizes the surface area otherwise available for use by radiator elements. A straight-forward adaptation of the corporate structured microstrip feedline for a series fed microstrip array similarly utilizes a portion of the available surface area. However, certain types of array aperture distributions make it impossible or impractical to utilize conventional feeding techniques for microstrip radiators.

Now, however, a new series fed array of microstrip radiating slot apertures has been discovered which is especially advantageous for realizing series fed antenna arrays of both one and two dimensions using microstrip radiators for defining radiating slot apertures in the arrays. Such novel series feed arrangements have also been discovered as being especially advantageous in permitting one to achieve desired amplitude and phase tapers across the array aperture. When a combination of single dimension arrays according to this invention are combined to provide a two-dimensional array, special array functions are also advantageously realizable such as, for example, dual polarization.

In one aspect of this invention, it may be noted that the microstrip radiators are used not only to define radiating slot apertures as in conventional microstrip antenna structures but, in addition, the microstrip radiator conductive element is also utilized, in part, as a transmission line which, in conjunction with interconnecting segments or non-radiating transmission line, permit the desired antenna array configurations to be realized in a single surface of integrally formed radiator and feedline conductive elements thereby combining the advantages of series fed waveguide arrays with the advantages of microstrip antenna arrays to provide multiple beam capacity, frequency steering, specialized aperture distributions, low cost fabrication, thinness, conformal design, etc.

A more complete understanding of this invention as well as its further objects and advantages will be had from the following detailed description of several exemplary embodiments of the invention taken in conjunction with the accompanying drawings of which:

Figure 3:
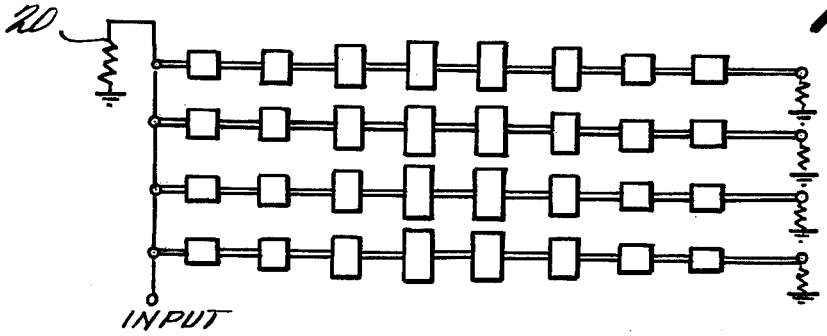
Figure 4:
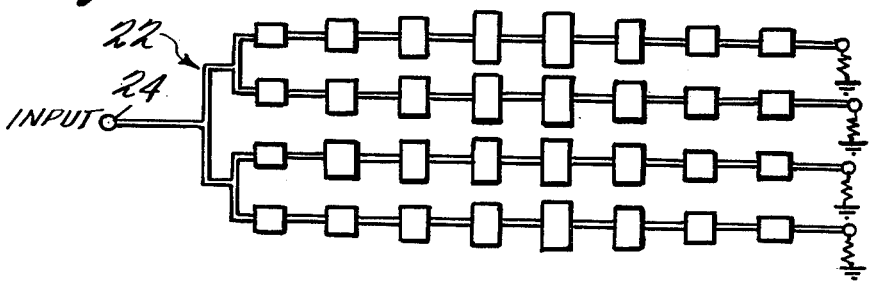
Figure 5:
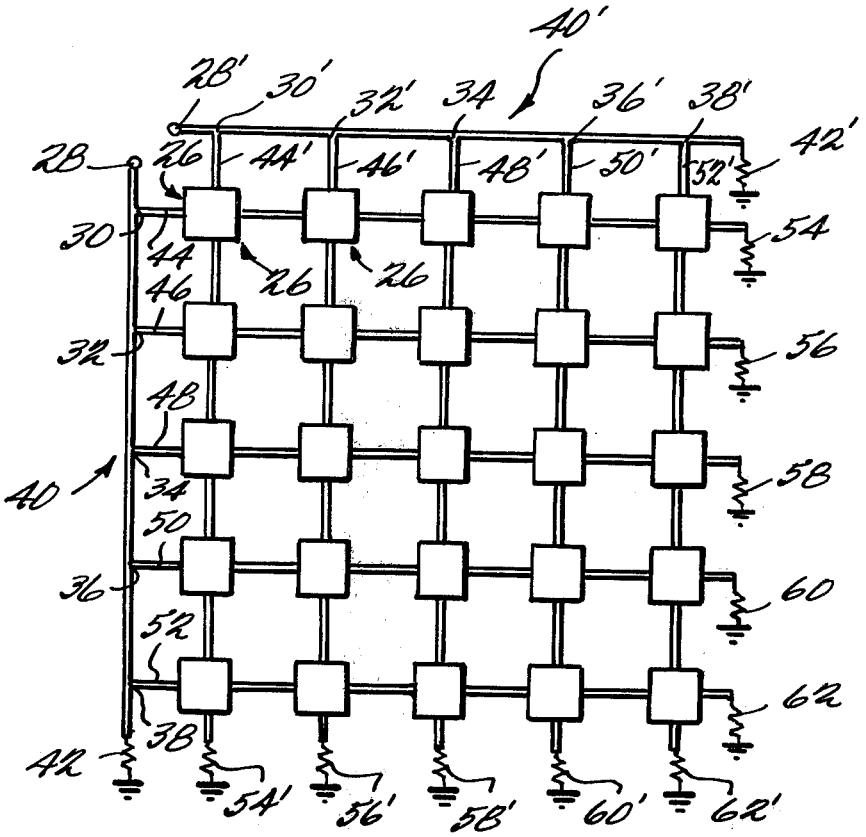

FIGS. 3 and 4 show exemplary embodiments of two-dimensional arrays constructed from a plurality of one-dimensional arrays according to this invention and utilizing two different exemplary radio frequency feed structures for the individual one-dimensional arrays constituting the overall two-dimensional array structures; and FIG. 5 shows an exemplary two-dimensional array embodiment comprising a plurality of one-dimensional arrays according to this invention with two separate sets of feedline structures leading to/from two separate feed points each providing a different overall antenna array polarization thereby providing a dual polarized two-dimensional antenna array.

As earlier mentioned, prior microstrip arrays were typically designed with a corporate structure feedline. In such corporate structure feedlines, the lengths of transmission line from a central feed point to the individual conductive elements defining the radiating apertures are either exactly equal or nearly equal with small differential lengths so as to establish a desired phase taper across the array. While this prior feedline arrangement has many advantages for many applications, the lengths of transmission line involved necessarily consume a considerable portion of the surface area. This unavoidable fact precludes or severely limits the use of such corporate feedline structures in some more complex aperture configurations such as a multiple beam and dual polarization configurations. Furthermore, in some array applications, it is desirable to steer the beam of the antenna array as a function of frequency which cannot be done with a conventional corporate feedline structure.

In adapting the corporate structure feedline to a series fed array configuration, one approach would be to simply provide a length of standard microstrip transmission line with T connection tap points spaced along its length to feed a series of individual microstrip radiator elements. A matched termination at the far end of the transmission line might be required as will be appreciated however, this approach would still require a portion of the available surface area to be devoted exclusively to the transmission line function and, in some applications, not even this limited amount of surface area would be available. Furthermore, such an approach to a series fed array would not simplify the problem encountered when trying to realize a dual polarization array aperture.

Figure 1:
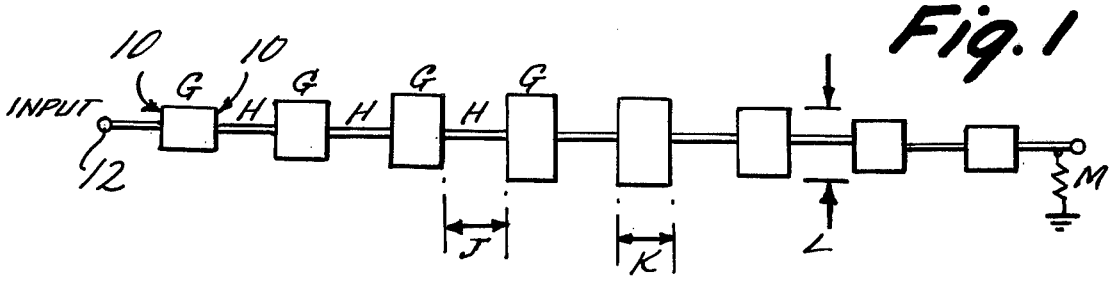
FIG. 1 shows a first exemplary embodiment of a one-dimensional array according to this invention wherein the individual radiator elements are sized in proportion to the amount of energy to be radiated to/from the radiating slot apertures associated therewith.

The presently preferred embodiment of this invention is shown in FIG. 1. Here, short lengths of standard non-radiating microstrip transmission line H interconnect the radiator elements G in series along a predetermined one-dimensional path. As should be appreciated, there is also an electrically conductive reference surface or ground plane (not shown) underlying the entire array structure shown in FIG. 1 while the electrically conductive radiator elements G and interconnecting integrally formed microstrip transmission line segments H overlie that electrically conductive reference or ground plane surface and are separated therefrom by a layer of dielectric material (not shown) interspersed between the ground plane surface and the conductive elements shown in FIG. 1.

Each of the radiator surfaces G defines at least one radiating slot aperture between an edge thereof and the underlying reference or ground plane surface. For example, as shown in FIG. 1, each of the radiator surfaces G defines a pair of radiating slot apertures extending along the edges of the radiator surfaces disposed transversely to the pre-determined path along which the transmission line segments H are placed. Each of the radiator surfaces G has an effective substantially one-half wavelength dimension K transverse to the radiating slot apertures 10 (the one-half wavelength dimension is determined in the dielectric material at the anticipated antenna operating frequency) thereby making the cavity between each pair of apertures resonant and producing additive radiation from each pair of slot apertures 10.

The strip trasmission line means H interconnects the radiator surfaces G in series along the predetermined path so as to conduct radio frequency energy to/from the radiating slot apertures 10 and a common feed point 12 for the antenna array shown in FIG. 1. The phase taper across the entire array aperture is therefore determined by the length of the transmission line segments J. As already mentioned, dimension K determines the resonance of the radiating elements; however, this dimension also has a second order dependence on dimension L, the length of the radiating slot apertures since when dimension L is less than about one-half wavelength (freespace), fringing fields will cause the effective dielectric constant to be slightly lower than the actual dielectric constant of the dielectric spacing material.

In the preferred embodiment shown in FIG. 1, the width L of the radiating slot apertures is selected so that the desired fraction of incident radio frequency power is radiated to/from those particular apertures. Therefore, as radio frequency power propogates down the transmission line, a predetermined fraction of it is radiated by each element at a predetermined phase. If such an array is designed so as to have unradiated power left at the end of the transmission line, it may be absorbed by a matched termination M as shown in FIG. 1 and as will be appreciated. Accordingly, in this embodiment of the invention, the radiator surfaces G have predetermined dimensions L in a direction transverse to the predetermined path of the transmission line H wherein such predetermined dimensions correspond to the predetermined relative proportion of radio frequency energy which is to be radiated to/from the slot apertures 10 associated therewith so as to determine the amplitude taper across the total array aperture.

Figure 2:
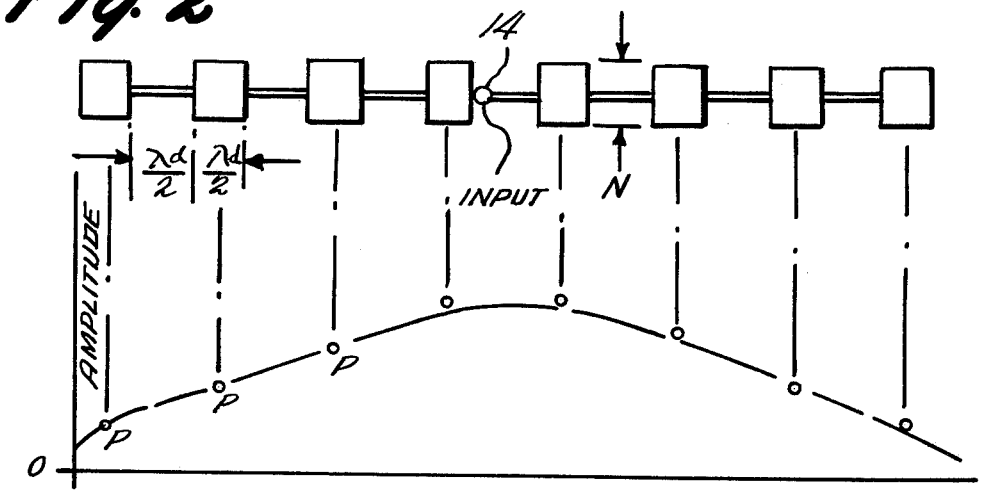
FIG. 2 shows a second exemplary embodiment of a one-dimensional array constructed according to this invention and utilizing internal reflections within the array to realize a predetermined amplitude taper across the array aperture as is also dipicted in FIG. 2.

The embodiment shown in FIG. 2 represents a special case where a termination for the transmission line is not required. While the FIG. 2 embodiment may at first glance appear to have similarity to what has been referred to as a resonant series fed array, it should be noted that a standard resonant series fed array is designed with each transmission line section being matched to the impedence to which it is connected. However, as in the embodiment of FIG. 2, if one permits reflections to occur within the array section, then the amplitude taper across the entire array aperture can be diminished toward the ends of the array without adjusting the element or radiating slot aperture width N. Accordingly, if the array is fed as shown in FIG. 2 at the middle such as at common feed point 14, a very useful and simple aperture distribution P as also shown in FIG. 2 is achieved, which overall array aperture amplitude distribution generates very low side lobes.

If a two-dimensional array is desired, a plurality of one-dimensional arrays as shown in FIGS. 1 and 2 may be combined. For example, as shown in FIGS. 3 and 4, a plurality of the exemplary embodiments shown in FIG. 1 may be arrayed and fed in series from tap points along a standard microstrip transmission feedline 16 leading from a common input point 18 to a matched termination 20, if one is required. Similarly, a plurality of the exemplary embodiments shown in FIG. 1 may be combined as shown in FIG. 4 to provide a two-dimensional array wherein each one-dimensional component of the two-dimensional array is fed in parallel from a corporate structured microstrip transmission line generally indicated at 22 in FIG. 4 and connected to a common input feed point 24.

The two-dimensional array shown in FIG. 5 is also formed from a plurality of single dimensional arrays. With respect to the apertures 26 oriented in the vertical direction as shown in FIG. 5, the array is fed from a common feed point 28 through tap points 30, 32, 34, 36 and 38 along the microstrip transmission line 40 which is terminated at 42. The individual one-dimensional arrays extending from the tap points 30-38 in a left-to-right fashion as shown in FIG. 5 are fed by segments of microstrip transmission lines 44, 46, 48 50 and 52 respectively extending from left to right as shown in FIG. 5 and in a manner as should now be apparent from the earlier discussion. In the particular exemplary embodiment shown in FIG. 5, each of the radiator elements would intercept equal proportions of the incident radio frequency energy propogating down the respectively associated transmission lines 44–52 as should now be apparent with any residue being absorbed in matched terminations 54, 56, 58, 60 and 62.

Viewed in another perspective, the two-dimensional array shown in FIG. 5 also comprises radiating apertures 26′ oriented horizontally as viewed in FIG. 5. These apertures are fed from a common feed point 28′ from tap points 30′, 32′, 34′, 36′ and 38′ along transmission line 40′ with the residue being absorbed in termination 42′.

The radio frequency energy tapped off of transmission line 40′ is then conducted along transmission line segments 44′, 46′, 48′, 50′ and 52′ along the vertically oriented (as seen in FIG. 5) one dimensional series fed arrays comprising the overall two-dimensional array. The residue of energy thus conducted along these series fed arrays is dissipated in matched terminations 54′, 56′, 58′, 60′, and 62′.

It should now be appreciated that when feed point 28 is utilized in the array of FIG. 5, the overall two-dimensional array will have a first polarization characterized by the vertical orientation (as seen in FIG. 5) of the radiating slot apertures 26. On the other hand, if feed point 28′ is utilized, then the overall two-dimensional array will have a different polarization characterized by the horizontal (as seen in FIG. 5) orientation of radiating slot apertures 26′. Accordingly, the two-dimensional array of FIG. 5 is actually a dual polarized array wherein the polarization characteristic for the overall array may be selected by selecting the corresponding feed point 28 or 28′.

As maybe seen in FIG. 5, the plurality of radiator surfaces involved provide a plurality of individual one-dimensional arrays spaced apart along first and second (horizontal and vertical as seen in FIG. 5) sets of intersecting paths. Strip transmission line means is then provided for interconnecting the radiator surfaces along the horizontal set of paths and with a first common feed point 28 for the total two-dimensional array when operating in the first mode of radiation polarization. Strip transmission line means is also provided interconnecting the radiator surfaces along each of the vertical set of intersecting paths and with a second common feed point 28′ for the total two-dimensional array when operating in a second mode of radiation polarization.

It should be appreciated by those in the art that the radiating slot apertures described herein and the various arrays thereof described herein may be utilized either for transmitting or receiving radio frequency energy. Likewise, the predetermined one-dimensional paths along which the one-dimensional arrays are disposed need not be straight lines but may be conformed to various curves as necessary for particular applications. Furthermore, it should be recognized that the novel features of this invention can be combined in combinations and/or permutations other than those specifically described in particular exemplary embodiments above. Accordingly, all such variations and/or modifications are intended to be included within the scope of this invention as defined by the following appended claims.

What is claimed is:

1. A microstrip antenna array of radiating slot apertures comprising:

an electrically conductive reference surface;

a layer of dielectric material overlying said reference surface;

a plurality of electrically conductive radiator surfaces overlying said dielectric material and spaced apart along a predetermined path, each of said radiator surfaces defining at least one radiating slot aperture between an edge thereof and the underlying reference surface, each of said radiator surfaces having an effective substantially one-half wavelength dimension transverse to said radiating slot aperture at the anticipated antenna operating frequency, said radiating slot apertures extending along the edges of the radiator surfaces being disposed transversely of said predetermined path, strip transmission line means overlying said dielectric material and interconnecting said radiator surfaces in series along said predetermined path so as to conduct radio frequency energy to/from said radiating slot apertures and a common feed point for the antenna array.

2. An antenna array of radiating slot apertures as in claim 1 wherein each of said radiator surfaces includes two parallel edges spaced apart by substantially one-half wavelength at the anticipated antenna operating frequency and thereby defining two parallel radiating slot apertures disposed transversely of said predetermined path.

3. An antenna array of radiating slot apertures as in claim 2 wherein said radiator surfaces are spaced apart along said predetermined path by predetermined distances corresponding to the predetermined desired phase shift in radio frequency energy along said strip transmission line means between said radiator surfaces thereby determining the phase taper across the total array aperture.

4. An antenna array of radiating slot aperturs as in claim 3 wherein said common feed point is interposed within said plurality of radiator surfaces along said strip transmission line means, said array being terminated in a manner so as to cause reflections of radio frequency energy along said series connected array thereby determining the amplitude taper across the total array structure.

5. A two-dimensional antenna array of radiating slot apertures comprising a plurality of individual arrays as in claim 3, each of said individual arrays being disposed along a respectively associated predetermined path and comprising a total two-dimensional array feed means connected to conduct radio frequency energy to/from each of the individual array strip transmission line means common feed points and a common feed point for the total two-dimensional array.

6. An antenna array of radiating slot apertures as in claim 1 wherein said common feed point is interposed within said plurality of radiator surfaces along said strip transmission line means, said array being terminated in a manner so as to cause reflections of radio frequency energy along said series connected array thereby determining the amplitude taper across the total array structure.

7. A two-dimensional antenna array of radiating slot apertures comprising a plurality of individual arrays as in claim 6, each of said individual arrays being disposed along a respectively associated predetermined path and comprising a total two-dimensional array feed means connected to conduct radio frequency energy to/from each of the individual array strip transmission line means common feed points and a common feed point for the total two-dimensional array.

8. A two-dimensional antenna array of radiating slot apertures comprising a plurality of individual arrays as in claim 1, each of said individual arrays being disposed along a respectively associated predetermined path and comprising a total two-dimensional array feed means connected to conduct radio frequency energy to/from each of the individual array strip transmission line means common feed points and a common feed point for the total two-dimensional array.

9. A microstrip antenna array of radiating slot apertures comprising:

an electrically conductive reference surface;

a layer of dielectric material overlying said reference surface;

a plurality of electrically conductive radiator surfaces overlying said dielectric material and spaced apart along a predetermined path, each of said radiator surfaces defining at least one radiating slot aperture between an edge thereof and the underlying reference surface, each of said radiator surfaces having an effective substantially one-half wavelength dimension transverse to said radiating slot aperture at the anticipated antenna operating frequency, said radiating slot apertures extending along the edges of the radiator surfaces being disposed transversely of said predetermined path, and strip transmission line means overlying said dielectric material and interconnecting said radiator surfaces in series along said predetermined path so as to conduct radio frequency energy to/from said radiating slot apertures and a common feed point for the antenna array, said radiator surfaces being spaced apart along said predetermined path by predetermined distances corresponding to the predetermined desired phase shift in radio frequency energy along said strip transmission line means between said radiator surfaces thereby determining the phase taper across the total array aperture.

10. An antenna array of radiating slot apertures as in claim 9 wherein said common feed point is interposed within said plurality of radiator surfaces along said strip transmission line means, said array being terminated in a manner so as to cause reflections of radio frequency energy along said series connected array thereby determining the amplitude taper across the total array structure.

11. A two-dimensional antenna array of radiating slot apertures comprising a plurality of individual arrays as in claim 9, each of said individual arrays being disposed along a respectively associated predetermined path and comprising a total two-dimensional array feed means connected to conduct radio frequency energy to/from each of the individual array strip transmission line means common feed points and a common feed point for the total two-dimensional array.

12. An antenna array comprising:

an electrically conductive reference surface;

a layer of dielectric material overlying said reference surface;

a plurality of electrically conductive radiator surfaces overlying said dielectric material and spaced apart;

each of said radiator surfaces defining at least one radiating slot aperture between an edge thereof and the underlying reference surface;

each of said radiator surfaces having an effective substantially one-half wavelength dimension transverse to said radiating slot aperture at the anticipated antenna operating frequency;

strip transmission line means overlying said dielectric material and interconnecting said radiator surfaces in series along said predetermined path so as to conduct radio frequency energy to/from said radiating slot apertures and a common feed point for the antenna array; and wherein said radiator surfaces have predetermined dimensions in a direction transverse to said predetermined path respectively corresponding to a predetermined relative proportion of radio frequency energy which is to be radiated or sensed thereby determining the amplitude taper across the total array aperture.

13. An antenna array as in claim 12 wherein said common feed point is interposed within said plurality of radiator surfaces along said strip transmission line means, said array being terminated in a manner so as to cause reflections of radio frequency energy along said series connected array thereby determining the amplitude taper across the total array structure.

14. A two-dimensional antenna array comprising a plurality of individual arrays as in claim 12, each of said individual arrays being disposed along a respectively associated predetermined path and comprising a total two-dimensional array feed means connected to conduct radio frequency energy to/from each of the individual array strip transmission line means common feed points and a common feed point for the total two-dimensional array.

15. A dual polarized two-dimensional antenna array comprising a plurality of individual arrays as in claim 12, wherein:

the plurality of radiator surfaces comprising said plurality of individual arrays are spaced apart along first and second sets of intersecting paths;

said strip transmission line means interconnecting said radiator surfaces along each of said first set of intersecting paths and also with a first common feed point for the total two-dimensional array when operating in a first mode of radiation polarization; and said strip transmission line means interconnecting said radiator surfaces along each of said second set of intersecting paths and also with a second common feed point for the total two-dimensional array when operating in a second mode of radiation polarization.

16. An antenna array comprising:

an electrically conductive reference surface;

a layer of dielectric material overlying said reference surface;

a plurality of electrically conductive radiator surfaces overlying said dielectric material and spaced apart;

each of said radiator surfaces defining at least one radiating slot aperture between an edge thereof and the underlying reference surface;

each of said radiator surfaces having an effective substantially one-half wavelength dimension transverse to said radiating slot aperture at the anticipated antenna operating frequency;

strip transmission line means overlying said dielectric material and interconnecting said radiator surfaces in series along said predetermined path so as to conduct radio frequency energy to/from said radiating slot apertures and a common feed point for the antenna array;

each of said radiator surfaces including two edges spaced apart by substantially one-half wavelength at the anticipated antenna operating frequency and thereby defining two radiating slot apertures disposed transversely of said predetermined path;

said radiator surfaces being spaced apart along said predetermined path by predetermined distance corresponding to the predetermined desired phase-shift in radio frequency energy along said strip transmission line means between said radiator surfaces thereby determining the phase taper across the total array aperture; and said radiator surfaces having predetermined dimensions in a direction transverse to said predetermined path respectively corresponding to a predetermined relative proportion of radio frequency energy which is to be radiated or sensed thereby determining the amplitude taper across the total array aperture.

17. A dual polarized two dimensional antenna array comprising a plurality of individual arrays, each individual array comprising:

an electrically conductive reference surface;

a layer of dielectric material overlying said reference surface;

a plurality of electrically conductive radiator surfaces overlying said dielectric material and spaced apart;

each of said radiator surfaces defining at least one radiating slot aperture between an edge thereof and the underlying reference surface;

each of said radiator surfaces having an effective substantially one-half wavelength dimension transverse to said radiating slot aperture at the anticipated antenna operating frequency;

strip transmission line means overlying said dielectric material and interconnecting said radiator surfaces in series along said predetermined path so as to conduct radio frequency energy to/from said radiating slot apertures and a common feed point for the antenna array;

each of said radiator surfaces including two edges spaced apart by substantially one-half wavelength at the anticipated antenna operating frequency and thereby defining two radiating slot apertures disposed transversely of said predetermined path;

said radiator surfaces being spaced apart along said predetermined path by predetermined distances corresponding to the predetermined desired phase shift in radio frequency energy along said strip transmission line means between said radiator surfaces thereby determining the phase taper across the total array aperture; and the plurality of radiator surfaces comprising said plurality of individual arrays being spaced apart along first and second sets of intersecting paths;

said strip transmission line means interconnecting said radiator surfaces along each of said first set of intersecting paths and also with a first common feed point for the total two-dimensional array when operating in a first mode of radiation polarization; and said strip transmission line means interconnecting said radiator surfaces along each of said second set of intersecting paths and also with a second common feed point for the total two-dimensional array when operating in a second mode of radiation polarization.

18. An antenna array comprising:

an electrically conductive reference surface;

a layer of dielectric material overlying said reference surface;

a plurality of electrically conductive radiator surfaces overlying said dielectric material and spaced apart;

each of said radiator surfaces defining at least one radiating slot aperture between an edge thereof and the underlying reference surface;

each of said radiator surfaces having an effective substantially one-half wavelength dimension transverse to said radiating slot aperture at the anticipated antenna operating frequency;

strip transmission line means overlying said dielectric material and interconnecting said radiator surfaces in series along said predetermined path so as to conduct radio frequency energy to/from said radiating slot apertures and a common feed point for the antenna array;

said radiator surfaces being spaced apart along said predetermined path by predetermined distances corresponding to the predetermined desired phase shift in radio frequency energy along said strip transmission line means between said radiator surfaces thereby determining the phase taper across the total array aperture; and said radiator surfaces having predetermined dimensions in a direction transverse to said predetermined path respectively corresponding to a predetermined relative proportion of radio frequency energy which is to be radiated or sensed thereby determining the amplitude taper across the total array aperture.

19. A dual polarized two-dimensional antenna comprising a plurality of individual arrays, each individual array comprising:

an electrically conductive reference surface;

a layer of dielectric material overlying said reference surface;

a plurality of electrically conductive radiator surfaces overlying said dielectric material and spaced apart;

each of said radiator surfaces defining at least one radiating slot aperture between an edge thereof and the underlying reference surface;

each of said radiator surfaces having an effective substantially one-half wavelength dimension transverse to said radiating slot aperture at the anticipated antenna operating frequency;

strip transmission line means overlying said dielectric material and interconnecting said radiator surfaces in series along said predetermined path so as to conduct radio frequency energy to/from said radiating slot apertures and a common feed point for the antenna array;

said common feed point being interposed within said plurality of radiator surfaces along said strip transmission line means and said individual array being terminated in a manner so as to cause reflections of radio frequency energy along said series connected array thereby determining the amplitude taper across the total array structure; the plurality of radiator surfaces comprising said plurality of individual arrays being spaced apart along first and second sets of intersecting paths;

said strip transmission line means interconnecting said radiator surfaces along each of said first set of intersecting paths and also with a first common feed point for the total two-dimensional array when operating in a first mode of radiation polarization; and said strip transmission line means interconnecting said radiator surfaces along each of said second set of intersecting paths and also with a second common feed point for the total two-dimensional array when operating in a second mode of radiation polarization.

20. A dual polarized two-dimensional antenna array comprising a plurality of individual arrays, each individual array comprising:

an electrically conductive reference surface;

a layer of dielectric material overlying said reference surface;

a plurality of electrically conductive radiator surfaces overlying said dielectric material and spaced apart;

each of said radiator surfaces defining at least one radiating slot aperture between an edge thereof and the underlying reference surface;

each of said radiator surfaces having an effective substantially one-half wavelength dimension transverse to said radiating slot aperture at the anticipated antenna operating frequency;

strip transmission line means overlying said dielectric material and interconnecting said radiator surfaces in series along said predetermined path so as to conduct radio frequency energy to/from said radiating slot apertures and a common feed point for the antenna array;

the plurality of radiator surfaces comprising said plurality of individual arrays being spaced apart along first and second sets of intersecting paths;

said strip transmission line means interconnecting said radiator surfaces along each of said first set of intersecting paths and also with a first common feed point for the total two-dimensional array when operating in a first mode of radiation polarization; and said strip transmission line means interconnecting said radiator surfaces along each of said second set of intersecting paths and also with a second common feed point for the total two-dimensional array when operating in a second mode of radiation polarization.

21. A two-dimensional array of radiating slot apertures comprising:

an electrically conductive reference surface;

a layer of dielectric material overlying said reference surface;

a plurality of conductive areas overlying said dielectric material and spaced apart from one another in intersecting rows and columns to form a two-dimensional array of such areas;

each of said conductive areas having predetermined first and second resonant dimensions along orthogonal directions so as to transmit/receive radio frequency energy; and strip transmission line means overlying said dielectric material along said rows and columns and serially interconnecting said two-dimensional array of conductive areas along said rows and columns with one or more radio frequency input/output terminals.

22. A two-dimensional array as in claim 21 wherein the strip transmission line means extending along said rows are connected to a first radio frequency input/output terminal and the strip transmission line means extending along said columns are connected to a second radio frequency input/output terminal.

23. A two-dimensional array as in claim 21 wherein one end of the strip transmission line means extending along each row and column is terminated in an impedance matched termination.

24. A two dimensional array as in claim 22 wherein one end of the strip transmission line means extending along each row and column is terminated in an impedance matched termination.

25. A two-dimensional array as in claim 23 wherein the strip transmission line means connections to the first and second input/output terminals are made in common along one end of the strip transmission line means in each column and in each row.

26. A microstrip antenna array of radiating slot apertures comprising:

an electrically conductive reference surface;

a layer of dielectric material overlying said reference surface;

a plurality of electrically conductive radiator surfaces overlying said dielectric material and spaced apart along a predetermined path;

each of said radiator surfaces defining at least one radiating slot aperture between an edge thereof and the underlying reference surface;

each of said radiator surfaces having an effective substantially one-half wavelength dimension transverse to said radiating slot aperture at the anticipated antenna operating frequency;

said radiating slot apertures extending along the edges of the radiator surfaces being disposed transversely of said predetermined path;

strip transmission line means overlying said dielectric material and interconnecting said radiator surfaces in series along said predetermined path so as to conduct radio frequency energy to/from said radiating slot apertures and a common feed point for the antenna array;

said common feed point being disposed at one end of said predetermined path; and an impedance matching termination being connected at the remaining other end of the predetermined path.

27. A microstrip antenna array of radiating slot apertures comprising:

an electrically conductive reference surface;

a layer of dielectric material overlying said reference surface;

a plurality of electrically conductive radiator surfaces overlying said dielectric material and spaced apart along a predetermined path;

each of said radiator surfaces defining at least one radiating slot aperture between an edge thereof and the underlying reference surface;

each of said radiator surfaces having an effective substantially one-half wavelength dimension transverse to said radiating slot aperture at the anticipated antenna operating frequency;

said radiating slot apertures extending along the edges of the radiator surfaces being disposed transversely of said predetermined path; and strip transmission line means overlying said dielectric material and interconnecting said radiator surfaces in series along said predetermined path with sections unequal to one-half wavelength so as to conduct radio frequency energy to/from said radiating slot apertures and a common feed point for the antenna array according to a predetermined phase taper across the array.

28. An antenna array as in claim 27 wherein:

said common feed point is disposed approximately midway along said predetermined path.

29. A two-dimensional dual polarized microstrip radio frequency antenna array comprising:

a plurality of individual microstrip radiators spaced apart from one another in a two-dimensional array;

said individual radiators exhibiting a first polarization characteristic when fed along a first direction and exhibiting a second polarization characteristic when fed along a second direction different from said first direction;

first non-radiating strip transmission line segments disposed along said first direction and serially interconnecting said microstrip radiators therealong so as to cause said first polarization characteristic to be exhibited when the array is fed therethrough; and second non-radiating strip transmission line segments disposed along said second direction and serially interconnecting said microstrip radiators therealong so as to cause said second polarization characteristic to be exhibited when the array is fed therethrough.

30. A two-dimensional dual polarized microstrip radio frequency antenna array as in claim 29 wherein said individual radiators comprise rectilinearly shaped conductive surfaces.

31. A two-dimensional dual polarized microstrip radio frequency antenna array as in claim 30 wherein said individual radiators comprise substantially square-shaped conductive surfaces.

32. A two-dimensional dual polarized microstrip radio frequency antenna array as in claim 29 wherein said first and second directions are substantially perpendicular to one another and wherein said first and second non-radiating strip transmission line segments are disposed along respectively corresponding sets of parallel lines.

33. A two-dimensional dual polarized microstrip radio frequency antenna array as in claim 32 wherein said individual radiators comprise rectilinearly shaped conductive surfaces.

34. A two-dimensional dual polarized microstrip radio frequency antenna array as in claim 33 wherein said individual radiators comprise substantially square-shaped conductive surfaces.

35. A dual polarized two-dimensional antenna array of radiating slot apertures including a plurality of individual arrays, each of said individual arrays comprising:

an electrically conductive reference surface;

a layer of dielectric material overlying said reference surface;

a plurality of electrically conductive radiator surfaces overlying said dielectric material and spaced apart along a predetermined path, each of said radiator surfaces defining at least one radiating slot aperture between an edge thereof and the underlying reference surface, each of said radiator surfaces having an effective substantially one-half wavelength dimension transverse to said radiating slot aperture at the anticipated antenna operating frequency, said radiating slot apertures extending along the edges of the radiator surfaces being disposed transversely of said predetermined path, strip transmission line means overlying said dielectric material and interconnecting said radiator surfaces in series along said predetermined path so as to conduct radio frequency energy to/from said radiation slot apertures and a common feed point for the antenna array, said radiator surfaces being spaced apart along said predetermined path by predetermined distances corresponding to the predetermined desired phase shift in radio frequency energy along said strip transmission line means between said radiator surfaces thereby determining the phase taper across the total array aperture the plurality of radiator surfaces comprising said plurality of individual arrays being spaced apart along first and second sets of intersecting path;

said strip transmission line means serially interconnecting said radiator surfaces along each of said first set of intersecting paths and also with a first common feed point for the total two-dimensional array when operating in a first mode of radiation polarization; and said strip transmission line means serially interconnecting said radiator surfaces along each of said second set of intersecting paths and also with a second common feed point for the total two-dimensional array when operating in a second mode of radiation polarization.

* * * * *